US008283289B2

(12) United States Patent
Araki

(10) Patent No.: US 8,283,289 B2
(45) Date of Patent: Oct. 9, 2012

(54) THERMAL TRANSFER SHEET

(75) Inventor: Tomoko Araki, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 447 days.

(21) Appl. No.: 12/593,352

(22) PCT Filed: Mar. 26, 2008

(86) PCT No.: PCT/JP2008/055746

§ 371 (c)(1), (2), (4) Date: Sep. 28, 2009

(87) PCT Pub. No.: WO2008/120640

PCT Pub. Date: Oct. 9, 2008

(65) Prior Publication Data

US 2010/0112246 A1 May 6, 2010

(30) Foreign Application Priority Data

Mar. 30, 2007 (JP) ..... 2007-092995

(51) Int. Cl.

| | |
|---|---|
| ***B41M 5/035*** | (2006.01) |
| ***B41M 5/385*** | (2006.01) |
| ***B41M 5/388*** | (2006.01) |
| ***B41M 5/39*** | (2006.01) |

(52) U.S. Cl. ..... 503/227; 8/471

(58) Field of Classification Search ..... None
See application file for complete search history.

(56) References Cited

U.S. PATENT DOCUMENTS 5,858,628 A * 1/1999 Yoshida et al. ..... 430/338

FOREIGN PATENT DOCUMENTS

| | | | |
|---|---|---|---|
| JP | 06-286346 | A | 10/1994 |
| JP | 07-304272 | A | 11/1995 |
| JP | 10-086535 | A | 4/1998 |
| JP | 2003-205686 | A | 7/2003 |

OTHER PUBLICATIONS

International Search Report: PCT/JP2008/055746.

* cited by examiner

*Primary Examiner* — Bruce H Hess
(74) *Attorney, Agent, or Firm* — Ladas & Parry LLP

(57) ABSTRACT

An object of the present invention is to provide a thermal transfer sheet provided with a black dye layer which can form a black image having jet-black color tone, small gradation difference of black and high resistance to light, and which has little offset of dyes to a back side layer during storage in a wound state. The above object is achieved by a thermal transfer sheet comprising a substrate, a heat resistant slip layer provided on one side of the substrate, and a black dye layer containing a dye and binder provided on the other side of the substrate, wherein the black dye layer contains 2 or 3 kinds of specific magenta dyes and 2 or 3 kinds of cyan dyes in the specific weight ratios with respect to a specific yellow dye.

3 Claims, 1 Drawing Sheet

THERMAL TRANSFER SHEET

TECHNICAL FIELD

The present invention relates to a thermal transfer sheet using a sublimation dye. More specifically, the present invention relates to a thermal transfer sheet provided with a black dye layer which can form a black image having jet-black color tone, small gradation difference of black and high resistance to light, and which has little offset of dyes to a back side layer.

BACKGROUND ART

Various thermal transfer recording methods have hitherto been known in the art. Among them, a method is proposed to form various full color images by utilizing a dye for sublimation transfer as a recording material, and thermally transferring the sublimation dye from a thermal transfer sheet onto a transfer-receiving material which can be dyed with sublimation dye, wherein the thermal transfer sheet comprises a dye layer formed by holding the sublimation dye by a suitable binder on a substrate such as a polyester film, and wherein the transfer-receiving material includes the thermal transfer image-receiving sheet comprising a dye receiving layer provided on paper, plastic film or the like. In this case, a large number of color dots of three or four colors with the quantity of heat being regulated are transferred by heating by means of a thermal head as heating means in a printer onto the receiving layer in the thermal transfer image-receiving sheet to reproduce a full color of an original by the multicolor dots. In this method, since coloring materials used are dyes, the formed images are very sharp and are highly transparent and thus are excellent in reproduction of intermediate colors and in gradation and are comparable with images formed by conventional offset printing or gravure printing. At the same time, this method can form high-quality images comparable with full-color images formed by photography. Therefore, the sublimation transfer method is used as a means of recording information in various fields.

Due to the development of various hardware and software related to multimedia, the thermal transfer method has been expanding its market as it is utilized for a full color hard copy system for digital images, typical examples of which include computer graphics, still images of satellite communication, CD-ROMs and so on, and analog images such as video. The image-receiving sheets formed by the thermal transfer method have wide-ranging specific usages. Examples of typical usages include printing of proof, output of images, output of planning and design by CAD/CAM, output of various kinds of medical analytical equipment and measuring instruments such as CT scanning and endoscopic cameras, output of photos for identifications, ID cards, credit cards and other cards as alternatives to instant photographs, and output of composite pictures and commemorative photographs at amusement facilities such as amusement parks, game arcades, museums and aquariums.

As one of the important properties required for the thermal transfer sheet of the sublimation transfer method, there is color reproducibility, particularly, reproducibility of black with high density. When forming a thermal transfer image of black by overprinting dyes of three colors from each dye layer of yellow, magenta and cyan in order, there is a problem that such black has poor reproducibility in jet-black color. That is, when dyes of three colors from each dye layer of yellow, magenta and cyan are overprinted in order, reproducibility of jet-black color is difficult, since dye layers of yellow, magenta and cyan need to give priority to balancing reproduction of those colors and intermediate colors, and in addition, there are problems such as subtractive mixture and technical restriction of thermal transfer. Therefore, a dye layer of black itself is required.

As a black thermal transfer sheet having such a dye layer of black itself, it has hitherto been known to obtain a black dye layer by mixing dyes of yellow, magenta and cyan (for example, Patent Literatures 1 and 2).

However, black color tone of printed matter obtained using the conventional black dye layer formed by mixing dyes of yellow, magenta and cyan takes on a red or green tinge, so that desired jet-black color has not always been capable of reproduction. Further, there has been a problem that a gradation difference of black is large.

In addition, printed matter obtained using the black dye layer formed by mixing dyes of yellow, magenta and cyan conventionally has a problem that significant color deterioration occurs due to light. In the case of mixing dyes having different color tone, the phenomenon called catalytic photobleaching, which causes significant color deterioration due to light, is often observed.

Further, in the conventional thermal transfer sheet having the black dye layer, the dye is transferred onto the heat-resistant slip layer provided on the back side of the thermal transfer sheet during storage in a wound state, and, at the time of rewinding, the dyes transferred onto the heat-resistant slip layer are retransferred (kicked back) onto dye layers of other colors or the like. If the contaminated dye layer is thermally transferred onto a thermal image-receiving sheet, the color is deviated from the designated color or a phenomenon, so-called "scumming" is caused.

On the other hand, Patent Literature 3 discloses a thermosensitive transfer sheet provided with color material layers of yellow, magenta and cyan, wherein each of the color material layer contains a thermal transferable pigment and a binder, and mentions a pigment used in the present invention as an example of a thermal transferable pigment contained in the color material layer of each color. However, Patent Literature 3 discloses a thermal transfer sheet wherein a black thermal transfer image is formed by overprinting dyes of three colors from each dye layer of yellow, magenta and cyan in order, and there is no description of black color tone. As shown in Comparative example described hereinafter, there is a problem that the combination of dyes disclosed in Patent Literature 3 cannot reproduce jet-black color desired as black color tone, and has large gradation difference of black so that smooth gradation of black is hardly realized.

CITATION LIST

[Patent Literature 1] Japanese Patent Application Laid-open (JP-A) No. 10-86535
[Patent Literature 2] JP-A No. 7-304272
[Patent Literature 3] JP-A No. 2003-205686

DISCLOSURE OF THE INVENTION

Technical Problem

Therefore, in order to solve the above problems, an object of the present invention is to provide a thermal transfer sheet provided with a black dye layer which can form a black image having jet-black color tone, small gradation difference of black and high resistance to light, and which has little offset of dyes to a back side layer during storage in a wound state.

Solution to Problem

In order to solve the above problem, the present invention provides a thermal transfer sheet comprising:

a substrate;

a heat resistant slip layer provided on one side of the substrate; and a black dye layer containing a dye and a binder provided on the other side of the substrate, wherein the black dye layer contains, with respect to 1 part by weight of a dye represented by the following Formula (1), 0.8 to 1.1 parts by weight of a dye represented by the following Formula (2a) and/or a dye represented by the following Formula (2b), 1.2 to 1.6 parts by weight of a dye represented by the following Formula (3), 1.3 to 1.7 parts by weight of a dye represented by the following Formula (4a) and/or a dye represented by the following Formula (4b), and 1.8 to 2.3 parts by weight of a dye represented by the following Formula (5).

[Chemical formula 1]

Formula 1

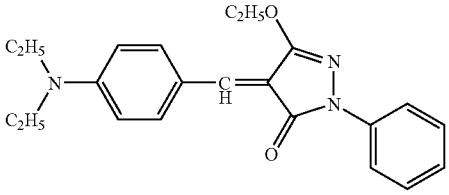

[Chemical formula 2]

Formula (2a)

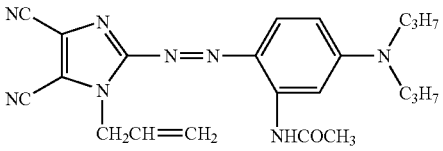

Formula (2b)

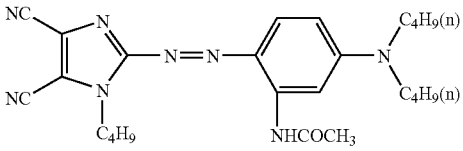

Formula (3)

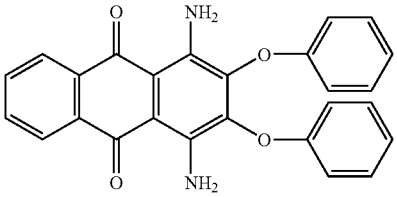

[Chemical formula 3]

Formula (4a)

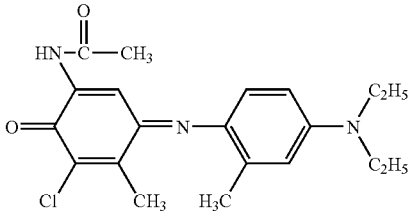

-continued

Formula (4b)

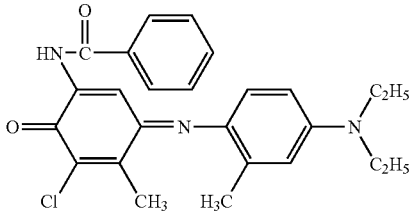

Formula (5)

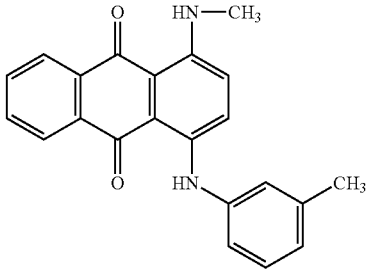

According to the present invention, by using the combination of specific amounts of 5 to 7 kinds of dyes having specific structures including the dye represented by Formula (1), the dye represented by Formula (2a) and/or the dye represented by Formula (2b), the dye represented by Formula (3), the dye represented by Formula (4a) and/or the dye represented by Formula (4b), and the dye represented by Formula (5) as dyes in the black dye layer, the black dye layer which can form a black image having jet-black color tone, small gradation difference of black and high resistance to light, and which has little offset of dyes to a back side layer during storage in a wound state can be obtained.

In the thermal transfer sheet of the present invention, it is preferable that a* value and b* value in CIELAB color system of a printed matter obtained by using the black dye layer and an image-receiving paper are respectively −3 to 5 and −5 to 3 from the viewpoint of black color tone.

Also, in the thermal transfer sheet of the present invention, it is preferable that a weight ratio (D/B) of a total amount (D) of dyes and a total amount (B) of binders in the black dye layer is 2 to 2.5 from the viewpoint of attaining a thermal transfer sheet with excellent coloring characteristics while preventing the dyes from transferring to the heat-resistant slip layer provided on the back side of the thermal transfer sheet during storage in a wound state.

Effect of the Invention

The thermal transfer sheet of the present invention provides an advantage that the thermal transfer sheet is provided with a black dye layer which can form a black image having jet-black color tone, small gradation difference of black and high resistance to light, and which has little offset of dyes to a back side layer during storage in a wound state.

REFERENCE SIGNS LIST

Figure 1:
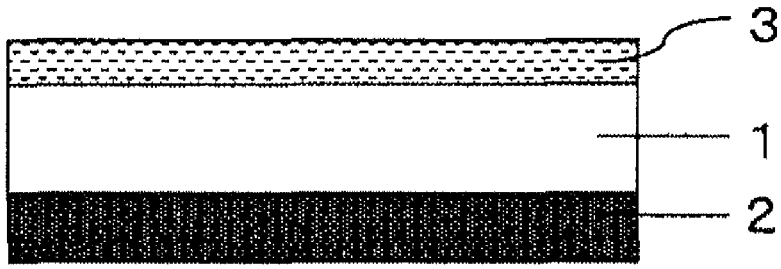
FIG. 1 is a schematic sectional view showing an embodiment of the thermal transfer sheet of the present invention.

| | |
|---|---|
| 1: | a substrate |
| 2: | a dye layer |
| 3: | a heat resistant slip layer |
| 4: | an undercoat layer. |

DESCRIPTION OF EMBODIMENT

The thermal transfer sheet according to the present invention comprises: a substrate; a heat resistant slip layer provided on one side of the substrate; and a black dye layer containing a dye and a binder provided on the other side of the substrate, wherein the black dye layer contains, with respect to 1 part by weight of a dye represented by the following Formula (1), 0.8 to 1.1 parts by weight of a dye represented by the following Formula (2a) and/or a dye represented by the following Formula (2b), 1.2 to 1.6 parts by weight of a dye represented by the following Formula (3), 1.3 to 1.7 parts by weight of a dye represented by the following Formula (4a) and/or a dye represented by the following Formula (4b), and 1.8 to 2.3 parts by weight of a dye represented by the following Formula (5).

[Chemical formula 4]

Formula (1)

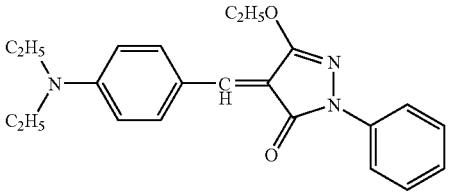

[Chemical formula 5]

Formula (2a)

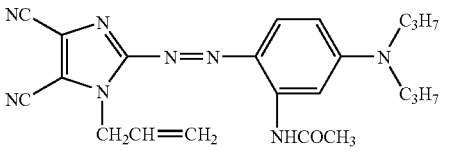

Formula (2b)

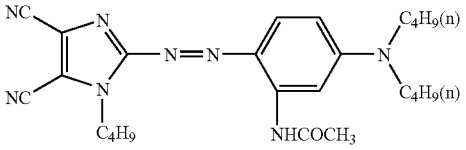

Formula (3)

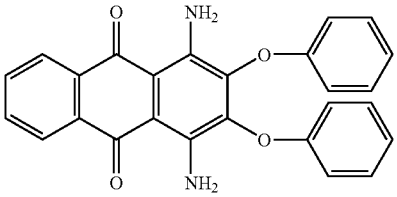

-continued

[Chemical formula 6]

Formula (4a)

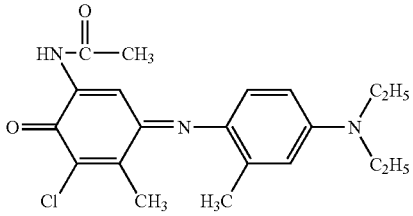

Formula (4b)

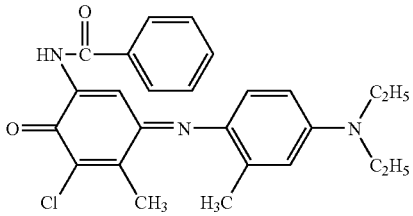

Formula (5)

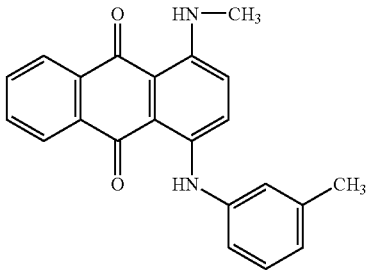

In the thermal transfer sheet of the present invention, the black dye layer is formed by using the combination of specific amounts of 5 to 7 kinds of dyes having specific structures, including the dye represented by Formula (1), the dye represented by Formula (2a) and/or the dye represented by Formula (2b), the dye represented by Formula (3), the dye represented by Formula (4a) and/or the dye represented by Formula (4b), and the dye represented by Formula (5).

Thereby, the black color tone of the printed matter obtained using the black dye layer can attain a jet-black color tone without taking on a red or green tinge. Particularly, according to the conventional thermal transfer sheet, the gradation difference of black is large, that is, depending on a given amount of energies, the black color tone obtained takes a green or red tinge at each gradation so that the color difference is large, thus, smooth gradation of black has been hardly attained. However, according to the thermal transfer sheet of the present invention, since the specific amounts of specific dyes are used in combination, a problem that some dyes are more and other dyes are less thermally transferred depending on the given amount of energies does not occur so that the combined dyes can be thermally transferred in a balanced manner. Thus, the gradation difference of black can be decreased, so that smooth gradation of black can be attained.

Also, according to the thermal transfer sheet of the present invention, a black image having high resistance to light can be formed since the specific amount of specific dyes are used in combination. Further, since the black dye layer of the thermal transfer sheet of the present invention has little offset of dyes to a back side layer during storage in a wound state, even in the embodiment that a yellow dye layer, a magenta dye layer and a cyan dye layer are provided in a face serial manner, retransfer (kick) of dyes of the black dye layer to dye layers of other colors can be prevented.

FIG. 1 is an embodiment of the thermal transfer sheet of the present invention. The thermal transfer sheet is constituted with a substrate 1, a heat resistant slip layer 3 provided on one surface of the substrate 1 to improve the slipping property of a thermal head and to prevent sticking, and a black dye layer 2 provided on another surface of the substrate 1.

Figure 2:
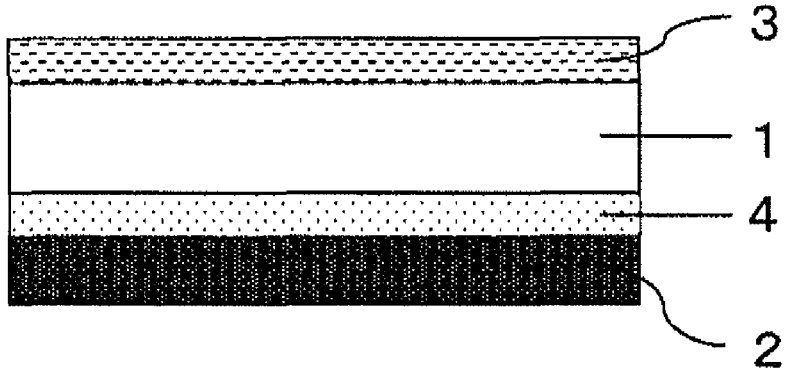
FIG. 2 is a schematic sectional view showing another embodiment of the thermal transfer sheet of the present invention.

FIG. 2 is another embodiment of the thermal transfer sheet of the present invention. The thermal transfer sheet is constituted with a substrate 1, a heat resistant slip layer 3 provided on one surface of the substrate 1, an undercoat layer 4 and a black dye layer 2 provided in this order on another surface of the substrate 1, wherein the undercoat layer is provided to improve adhesiveness between the substrate and the dye layer, and thermal transfer characteristics.

The thermal transfer sheet of the present invention comprises a substrate, a heat resistant slipping layer provided on one side of the substrate, and at least a black dye layer provided on the other side of the substrate. The dye layer provided on the other side of the substrate may be a single layer of black dye layer alone or a plurality of layers, in which a plurality of dye layers with different color tones including not only the black dye layer but also, for example, yellow, magenta and cyan dye layers are repeatedly formed in a face serial manner on the same surface of the same substrate. Further, the thermal transfer sheet of the present invention may have an embodiment that a thermal transfer protective layer, which imparts a function to protect transferred dyes, may be repeatedly formed in a face serial manner on the same surface of the same substrate.

The thermal transfer sheet of the present invention will now be explained in more detail, for each layer constituting the thermal transfer sheet of the present invention.

(Substrate)

The substrate 1 of the thermal transfer sheet used in the present invention may be any known substrate having a certain extent of heat resistance and strength. For example, a film having a thickness of 0.5 to 50 μm, preferably 1 to 10 μm may be used, including polyethylene terephthalate films, 1,4-polycyclohexylene dimethylene terephthalate films, polyethylene naphthalate films, polyphenylene sulfide films, polystyrene films, polypropylene films, polysulfone films, aramid films, polycarbonate films, polyvinyl alcohol films, cellulose derivatives such as cellophane and cellulose acetate, polyethylene films, polyvinyl chloride films, nylon films, polyimide films, ionomer films and so on.

A surface of the substrate, where the dye layer is formed thereon, is often treated in order to improve the adhesiveness. When the dye layer or the undercoat layer which will be hereinafter described is formed on the substrate, the substrate such as the plastic films is likely to have an insufficient adhesiveness relative to the dye layer or the undercoat layer. Therefore, the substrate such as the plastic film is preferably treated to improve its adhesiveness. A method for improving the adhesiveness may be any known method for improving the resin surface, such as corona discharge treatment, flame treatment, ozone treatment, ultraviolet treatment, radiation treatment, surface roughening treatment, chemical agent treatment, plasma treatment, low temperature plasma treatment, primer treatment, grafting treatment and so on. A combination of two or more of these treatment methods may also be used. The primer treatment may be carried out, for example, by coating, in melt extrusion of a plastic film to form a film, a primer liquid onto an unstretched film and then subjecting the assembly to stretching treatment. The corona discharge treatment or the plasma treatment is preferable among the above-listed methods, in view of availability at low cost.

(Black Dye Layer)

The black dye layer of the present invention is a layer wherein the following thermal transferable dyes specified in the present invention are used in combination in the specific amounts and are supported by any binder.

The black dye layer of the present invention contains, with respect to 1 part by weight of a dye represented by the following Formula (1), 0.8 to 1.1 parts by weight of a dye represented by the following Formula (2a) and/or a dye represented by the following Formula (2b), 1.2 to 1.6 parts by weight of a dye represented by the following Formula (3), 1.3 to 1.7 parts by weight of a dye represented by the following Formula (4a) and/or a dye represented by the following Formula (4b), and 1.8 to 2.3 parts by weight of a dye represented by the following Formula (5).

[Chemical formula 7]

Formula (1)

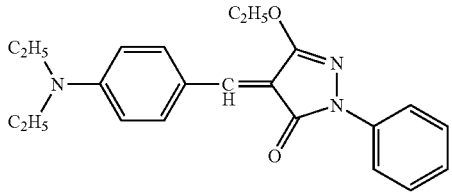

[Chemical formula 8]

Formula (2a)

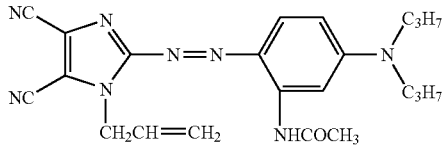

Formula (2b)

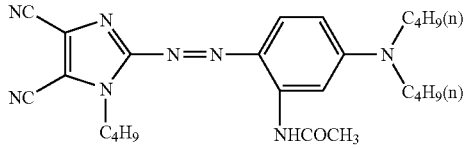

Formula (3)

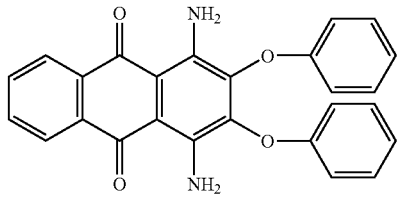

[Chemical formula 9]

Formula (4a)

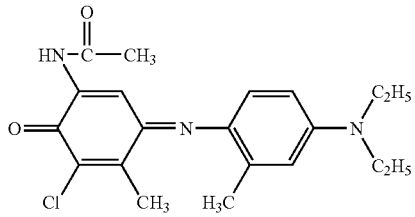

-continued

Formula (4b)

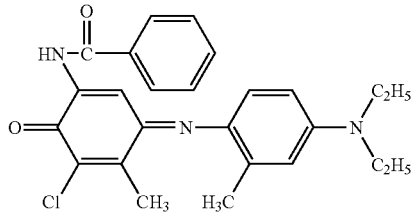

Formula (5)

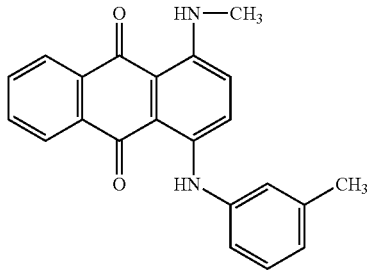

Particularly, the black dye layer of the present invention preferably contains 0.9 to 1.0 parts by weight of the dye represented by Formula (2a) and/or the dye represented by Formula (2b), 1.4 to 1.5 parts by weight of the dye represented by Formula (3), 1.4 to 1.6 parts by weight of the dye represented by Formula (4a) and/or the dye represented by Formula (4b) and 2.0 to 2.1 parts by weight of the dye represented by Formula (5), with respect to 1 part by weight of the dye represented by Formula (1), from the viewpoint of excellent black color tone and small gradation difference of black.

The black dye layer of the present invention preferably contains only 5 to 7 kinds of dyes having specific structures, including the dye represented by Formula (1), the dye represented by Formula (2a) and/or the dye represented by Formula (2b), the dye represented by Formula (3), the dye represented by Formula (4a) and/or the dye represented by Formula (4b), and the dye represented by Formula (5). Other dyes may be appropriately added as far as the effect of the invention is maintained.

Other specific examples of the dye include: diarylmethane dyes; triaryl methane dyes; thiazole dyes; methine dyes such as merocyanine and pyrazolone methine; azomethine dyes such as indoaniline, acetophenoneazomethine, pyrazoloazomethine, imidazoleazomethine, imidazoazomethine and pyridoneazomethine; xanthene dyes; oxazine dyes; cyanomethylene dyes such as dicyanostyrene and tricyanostyrene; thiazine dyes; azine dyes; acridine dyes; benzeneazo dyes; azo dyes such as pyridoneazo, thiopheneazo, isothiazoleazo, pyrrolazo, pyralazo, imidazoleazo, thiadazoleazo, triazoleazo and disazo; spiropyran dyes; indolinospiropyran dyes; fluorane dyes; rhodamine lactam dyes; naphthoquinone dyes; anthraquinone dyes; and quinophthalone dyes.

As the binder for the dye layer, any known resin binder may be used. Examples of preferable binder include: cellulose resins such as ethyl cellulose, hydroxyethyl cellulose, ethylhydroxy cellulose, hydroxypropyl cellulose, methyl cellulose, cellulose acetate and cellulose butyrate; vinyl resins such as polyvinyl alcohol, polyvinyl acetate, polyvinyl butyral, polyvinyl acetal, polyvinyl pyrrolidone and polyacrylamide; polyester resins; and phenoxy resins.

Also, a silane coupling agent may be added to the dye layer. Examples of the silane coupling agent include isocyanate group-containing compounds such as γ-isocyanate propyltriethoxy silane and γ-isocyanate propyltrimethoxy silane; amino group-containing compounds such as γ-aminopropyltriethoxy silane, γ-aminopropyltrimethoxy silane, N-β-(aminoethyl)-γ-aminopropyltriethoxy silane and γ-phenylaminopropyltrimethoxy silane; and epoxy group-containing compounds such as γ-glycidoxy propyltrimethoxy silane and β-(3,4-epoxycyclohexyl)ethyltrimethoxy silane. These compounds may be used alone or in combination of two or more kinds.

It is considered that a silanol group produced by hydrolysis of the silane coupling agent is condensed with a hydroxyl group of an inorganic compound existing at the surface of the thin layer and chemically combined, thus improving the adhesiveness. Furthermore, the epoxy group, the amino group or the like of the silane coupling agent reacts with a hydroxy group, a carboxyl group or the like of the resin binder and chemically combines, thereby the strength of the dye layer itself is enhanced and the break of the dye layer due to flocculation during thermal transfer can be prevented.

Instead of the resin binder, the present invention can use the following releasing graft copolymer as a releasing agent or a binder. The releasing graft copolymer is obtained by graft-polymerizing a polymer chain with at least one releasing segment selected from a polysiloxane segment, a fluorohydrocarbon segment or a long chain alkyl segment. Among them, the graft copolymer obtained by graft-polymerizing a main chain of polyvinyl acetal resin with the polysiloxane segment is particularly preferable.

As the binder resin constituting the dye layer, a highly adhesive resin having a hydroxy group or a carboxyl group including polyvinyl butyral, polyvinyl acetal, polyvinyl acetate, polyester resins, and cellulose resins such as cellulose acetate and cellulose butyrate, are suitably used alone or as a mixture thereof from the viewpoint of adhesiveness between the dye layer and the substrate or the undercoat layer described below at storage.

In the black dye layer of the present invention, the weight ratio (D/B) of the total amount (D) of dye and the total amount (B) of binder is preferably 2 to 2.5, more preferably 2.3 to 2.4, from the viewpoint of attaining the thermal transfer sheet with excellent coloring characteristics while preventing the dyes from being transferred onto the heat-resistant slip layer provided on the back side of the thermal transfer sheet during storage in a wound state.

In addition to the above-mentioned dye and binder, conventionally known various additives may be added, if needed. Examples of additives include organic or inorganic fine particles such as polyethylene wax, for improving the releasing property of the image-receiving sheet or the coating property of ink. Usually, such a dye layer can be formed by dissolving or dispersing the above-mentioned dye, binder and optionally additives into an appropriate solvent to prepare a coating liquid, then applying this coating liquid onto the substrate followed by drying. This coating method can be achieved by a known method such as gravure printing, screen printing or reverse roll coating with a use of gravure plate. The dye layer formed in this manner has a coating amount of 0.2 to 6.0 g/m$^2$, preferably 0.3 to 3.0 g/m$^2$, on a dry basis.

In the case that a plurality of dye layers with different color tones including not only the black dye layer but also, for example, yellow, magenta, and cyan dye layers, are repeatedly formed in a face serial manner on the same surface of the same substrate, the dye layers with different color tones may not be particularly limited, and can be formed similarly as the black dye layer using a combination of dyes appropriately.

(Heat Resistant Slip Layer)

In the thermal transfer sheet of the present invention, a heat resistant slip layer 3 is provided on one surface of the substrate in order to prevent a bad influence such as printing wrinkle or sticking by heat of the thermal head. The resin for forming the heat resistant slip layer may be any of conventionally known resins. Examples thereof include polyvinyl butyral resins, polyvinyl acetoacetal resins, polyester resins, vinyl chloride-vinyl acetate copolymers, polyether resins, polybutadiene resins, styrene-butadiene copolymers, acrylpolyols, polyurethane acrylates, polyesteracrylates, polyetheracrylates, epoxyacrylates, urethane or epoxy prepolymers, nitrocellulose resins, cellulose nitrate resins, cellulose acetate propionate resins, cellulose acetate butyrate resins, cellulose acetate hydrodiene phthalate resins, cellulose acetate resins, aromatic polyamide resins, polyimide resins, polyamideimide resins, polycarbonate resins, and polyolefin chloride resins.

The heat resistant slip layer may also be formed by adding a slipperiness-imparting agent to the resin, or by top-coating a slipperiness-imparting agent to the heat resistant slip layer formed of the resin. Specific examples of slipperiness-imparting agents include phosphoric esters, metallic soap, silicone oils, graphite powder, silicone graft polymers, fluoro graft polymers, acrylsilicone graft polymers, acrylsiloxanes, arylsiloxanes, and other silicone polymers. A preferred layer comprises a polyol, for example, a high-molecular polyalcohol compound, a polyisocyanate compound and a phosphoric ester compound, and addition of a filler is more preferred.

The heat resistant slip layer can be formed by dissolving or dispersing the above-mentioned resin, the slipperiness-imparting agent and additionally the filler into an appropriate solvent to prepare a coating liquid for heat resistant slip layer, and then applying the coating liquid by, for example, gravure printing, screen printing, or reverse roll coating with the use of a gravure plate followed by drying. The coating amount of the heat resistant slip layer is preferably 0.1 to 3.0 g/m$^2$ on a solid component basis.

(Undercoat Layer)

In the thermal transfer sheet of the present invention, an undercoat layer 4 may be provided between the substrate and the dye layer for the purpose of improving adhesiveness between the substrate and the dye layer, and thermal transfer characteristics.

Examples of preferable resins constituting the undercoat layer 4 formed in the thermal transfer sheet of the present invention include polyester resins, acrylic resins, urethane resins, alkyd resins, homopolymers of N-vinylpyrrolidone, and copolymers of N-vinylpyrrolidone and other components. In addition, it is preferable to add melamine compounds, isocyanate compounds, epoxy compounds, compounds containing an oxazoline group, chelate compounds or the like to the undercoat layer in order to improve the adhesiveness of the undercoat layer with the substrate, the dye layer or the protective layer, or the environmental storage stability.

Examples of the above-mentioned N-vinylpyrrolidone include N-vinyl-2-pyrrolidone, N-vinyl-3-pyrrolidone, and N-vinyl-4-pyrrolidone. There are homopolymers of such vinylpyrrolidones (homopolymers formed of monomers of the same kind) and copolymers formed of these monomers of different kinds. As such a polyvinylpyrrolidone resin, the resin with the grade of K-60 to K-120 in K value according to Fikentscher equation can be used. The number average molecular weight of the resin is about 30,000 to 280,000. By using the polyvinylpyrrolidone resin for the undercoat layer, transfer sensitivity can be improved and unevenness of transfer and inferior foil cutting property upon transfer of the protective layer can be prevented. If a polyvinylpyrrolidone resin with K value of less than 60 (K-15, K-30) is used, the advantage of improving transfer sensitivity in printing may not be able to be exhibited.

Also, a copolymer of the N-vinylpyrrolidone and any of other polymerizable monomers can be used. Examples of such a polymerizable monomer other than the N-vinylpyrrolidone include vinyl monomers such as styrene, vinyl acetate, acrylic ester, acrylic nitrile, maleic anhydride, vinyl chloride (fluoride) and vinylidene chloride (fluoride, cyanide). A copolymer obtained by radical copolymerization of the vinyl monomer, and N-vinylpyrrolidone can be used. Moreover, block copolymer, graft copolymers or the like of polyester resins, polycarbonate resins, polyurethane resins, epoxy resins, acetal resins, butyral resins, formal resins, phenoxy resins, cellulose resins or the like and polyvinylpyrrolidone can be used.

A resin other than the polyvinylpyrrolidone resin can be mixed into the undercoat layer to improve adhesiveness. Examples of the resin include polymers (copolymers) obtained by vinyl monomers such as styrene, vinyl acetate, acrylic ester, acrylic nitrile, maleic anhydride, vinyl chloride (fluoride), and vinylidene chloride (fluoride, cyanide), polyester resins, polycarbonate resins, polyurethane resins, epoxy resins, acetal resins, butyral resins, formal resins, phenoxy resins, cellulose resins, and polyvinyl alcohol resins. Such a resin component is preferably used at a ratio from 1 to 30 weight % with respect to the total amount of a solid content of the undercoat layer. If the amount of the resin component added is lower than the above range, sufficient adhesiveness may not be exhibited. If the amount of the resin component added exceeds the above range, the advantage of improvement in transfer sensitivity of polyvinylpyrrolidone may not be sufficiently exhibited.

The undercoat layer in the thermal transfer sheet of the present invention may be an undercoat layer made of colloidal inorganic pigment ultra-fine particles from the viewpoint of preventing transfer of dyes from the dye layer to the undercoat layer during printing, and effectively diffusing dyes to the receiving layer side of the image-receiving sheet to increase the transfer sensitivity in printing and the print density. Any known compound can be used as the colloidal inorganic pigment ultra-fine particles. Examples thereof include silica (colloidal silica), alumina or alumina hydrates such as alumina sols, colloidal alumina, cationic aluminum oxides and the hydrates thereof, and pseudo boehmite, aluminum silicate, magnesium silicate, magnesium carbonate, magnesium oxide, and titanium oxide. Particularly, colloidal silica and alumina sols are preferably used. The primary average particle size of these colloidal inorganic pigment ultra-fine particles may be 100 nm or less, preferably 50 nm or less, and more preferably 3 to 30 nm. Thereby, the undercoat layer can fully exhibit its function.

The colloidal inorganic pigment ultra-fine particles may be spherical, acicular, plate-like, feather-like, amorphous in shape, or of any other shape. Also, colloidal inorganic pigment ultra-fine particles treated to be acid type so that the particles can be easily dispersed in a sol form in an aqueous solvent, colloidal inorganic pigment ultra-fine particles subjected to cationization, or colloidal inorganic pigment ultra-fine particles subjected to surface treatment can be used. In view of the coating suitability when coating the undercoat layer, it is preferable that a coating liquid for the undercoat layer has a relatively low viscosity to be flowable.

Further, the undercoat layer of the thermal transfer sheet of the present invention may be an undercoat layer containing the above resin and the above colloidal inorganic pigment ultra-fine particles.

The undercoat layer can be formed by preparing a coating liquid formed of a composition in which the above-mentioned materials is dissolved, or dispersed in a sol form, in a solvent such as acetone, methyl ethyl ketone, toluene, xylene, alcohol or water, selected according to the coating suitability, applying the coating liquid on the surface of a substrate using a known coating means such as a gravure coater, a dye coater, a roll coater or a wire, and drying the coating liquid to solidify. The amount of coating on a dry basis may be 0.01 to 5 g/m$^2$, preferably 0.05 to 1 g/m$^2$.

The thermal transfer protective layer imparting a function to protect transferred dyes may be formed in the thermal transfer sheet of the present invention, and is not particularly limited. The thermal transfer protective layer can be formed by a known method, for example, a technique disclosed in JP-A No. 2003-312151.

The thermal transfer sheet of the present invention may be further provided with other structures such as detection marks, which are provided to thermal transfer sheets.

The color tone of black printed matter obtained using the black dye layer of the thermal transfer sheet of the present invention can realize black having reduced red and green tinges. When printing is performed on the following image-receiving sheet under the following printing conditions and the printed matter is measured by the following conditions for color measurement by means of a spectral photometer, a* value is preferably −3 to 5, more preferably −3 to 3, and b* value is preferably −5 to 3, more preferably −4 to 2, in CIELAB color system.

[Image-Receiving Sheet]

A thermal transfer image-receiving sheet specially designed for Compact photo printer CP-200 manufactured by Canon Inc.

[Printing Conditions]

Average resistance of heating element; 2,994 (Ω)

Print density in main scanning direction; 300 dpi

Print density in sub scanning direction; 300 dpi

Applied voltage; 0.10 (w/dot)

One line period; 5.0 (msec.)

Temperature upon starting printing; 40 (° C.)

Applied pulse (gradation control method); A test printer of a multi-pulse system was provided which had such a pulse length that one line period was divided into 256 equal parts and wherein the number of divided pulses could be varied from 0 to 255 during one line period, a duty ratio of each divided pulse was fixed at 70%, and the number of pulses per line period was separated into 15 levels between 0 and 255; thereby, 15 levels of different energies can be provided.

[Color Measurement Condition]

Chromaticity values L*, a*, and b* are measured by means of a spectrometer under the conditions including the white reference of the absolute value, and the density standard of D 50 light source and the observable field of view of 2°.

EXAMPLES

Next, the present invention will now be explained more in detail, with reference to Examples and Comparative examples. Hereinafter, "parts" or "%" is by weight unless otherwise specified.

Example 1

A coating liquid for a black dye layer having the following composition was coated on the easy-adhesion treated surface of a polyethylene terephthalate (PET) film (product name: Diafoil K203E; manufactured by Mitsubishi Polyester Film Corp.) having a thickness of 6 μm, one surface of which was subjected to easy-adhesion treatment, by gravure coating with a coating amount of 1.2 g/m$^2$ on a dry basis. After drying the coating liquid, a black dye layer was formed, and thus, a thermal transfer sheet of Example 1 was obtained. Preliminarily, a heat resistant slip layer was formed on the opposite surface of the substrate in such a manner that a primer layer composition liquid for a heat resistant slip layer having the following composition was coated and dried with a coating amount of 0.2 g/m$^2$ on a dry basis; and on the surface of the primer layer, the following composition liquid for a heat resistant slip layer was coated and dried with a coating amount of 1.0 g/m$^2$ on a dry basis followed by heating for 5 days at 60° C.

<Coating Liquid for Black Dye Layer>

Dye represented by Formula (1) 1.2 parts

Dye represented by Formula (2a) 1.1 parts

Dye represented by Formula (3) 1.7 parts

Dye represented by Formula (4a) 1.8 parts

Dye represented by Formula (5) 2.5 parts

Polyvinyl butyral resin (product name: S-LEC KS-5; manufactured by SEKISUI CHEMICAL CO., LTD.) 3.5 parts Methyl ethyl ketone 44.1 parts Toluene 44.1 parts <Primer Layer Composition Liquid for Heat Resistant Slip Layer>

Polyester resin 10.0 parts (product name: Nichigo polyester LP-035; manufactured by Nippon Synthetic Chemical Industry Co., Ltd.)

Methyl ethyl ketone 90.0 parts

<Coating Liquid for Heat Resistant Slip Layer>

Polyvinyl butyral resin (product name: S-LEC BX-1; manufactured by SEKISUI CHEMICAL CO., LTD.) 13.6 parts Polyisocyanate curing agent (product name: Takenate D218; manufactured by Takeda Pharmaceutical Company Limited.) 0.6 parts Phosphoric ester (product name: PLYSURF A208S; manufactured by Dai-ichi Kogyo Seiyaku Co., Ltd.) 0.8 parts Methyl ethyl ketone 42.5 parts Toluene 42.5 parts

Examples 2 to 7

Thermal transfer sheets of Examples 2 to 7 were produced similarly as in Example 1, except that the composition of each coating liquid for black dye layer was changed to the composition listed in Table 1.

TABLE 1

Compositions of coating liquid for black dye layer

| | Example 1 | Example 2 | Example 3 | Example 4 | Example 5 | Example 6 | Example 7 | Comparative Example 1 | Comparative Example 2 | Comparative Example 3 | Comparative Example 4 | Comparative Example 5 | Comparative Example 6 |
|---|---|---|---|---|---|---|---|---|---|---|---|---|---|
| Dye represented by Formula (1) | 1.2 | 1.3 | 1.3 | 1.1 | 1.2 | 1.2 | 1.2 | 1.1 | 2.5 | | | | |
| Dye represented by Formula (Y*1) | | | | | | | | | | 1.3 | 1.2 | 1.4 | 1.4 |

TABLE 1-continued

| Compositions of coating liquid for black dye layer | | | | | | | | | | | | | |
|---|---|---|---|---|---|---|---|---|---|---|---|---|---|
| | Example 1 | Example 2 | Example 3 | Example 4 | Example 5 | Example 6 | Example 7 | Comparative Example 1 | Comparative Example 2 | Comparative Example 3 | Comparative Example 4 | Comparative Example 5 | Comparative Example 6 |
| Dye represented by Formula (2a) | 1.1 | 1.1 | 1.1 | | 1.2 | 1.1 | 1.1 | 1.4 | 1.25 | 1.0 | | | |
| Dye represented by Formula (2b) | | | | | | | | | 1.25 | | | | |
| Dye represented by Formula (3) | 1.7 | 1.7 | 1.7 | 1.7 | 1.5 | 1.5 | 1.5 | 1.9 | | 1.7 | | | |
| Dye represented by Formula (M*1) | | | | | | | | | | | 1.5 | | |
| Dye represented by Formula (M*2) | | | | | | | | | | | 1.5 | | |
| Dye represented by Formula (M*3) | | | | | | | | | | | | 1.4 | |
| Disperse Red 343 | | | | | | | | | | | | | 1.5 |
| Dye represented by Formula (4a) | 1.8 | 1.8 | | 1.8 | 1.8 | 1.8 | 1.8 | 1.8 | | 1.8 | 2.0 | 0.5 | |
| Dye represented by Formula (4b) | | | 1.8 | | | | | | | | | | |
| Dye represented by Formula (5) | 2.5 | 2.5 | 2.5 | 2.5 | 2.5 | 2.8 | 2.6 | 2.5 | | 2.5 | 1.6 | 4.4 | 5.5 |
| Dye represented by Formula (C*1) | | | | | | | | | 1.25 | | | | |
| Dye represented by Formula (C*2) | | | | | | | | | 1.25 | | | | |
| Polyvinyl acetoacetal resin | 3.5 | 3.5 | 3.5 | 3.5 | 3.5 | 3.5 | 3.5 | 3.5 | 3.5 | 3.5 | 3.5 | 3.5 | 3.5 |
| Toluene | 44.1 | 44.1 | 44.1 | 44.2 | 44.2 | 44.1 | 44.2 | 43.9 | 44.5 | 44.1 | 44.4 | 44.4 | 44.1 |
| Methylethylketone | 44.1 | 44.1 | 44.1 | 44.2 | 44.2 | 44.1 | 44.2 | 43.9 | 44.5 | 44.1 | 44.4 | 44.4 | 44.1 |

Comparative Example 1

A thermal transfer sheet of Comparative example 1 was produced similarly as in Example 1, except that the composition of the coating liquid for black dye layer was changed to the composition listed in Table 1. The black dye layer of Comparative example 1 uses the dyes specified in the present invention, but the weight ratio for the combination of dyes is different from the amount specified in the present invention.

Comparative Example 2

A thermal transfer sheet of Comparative example 2 was produced similarly as in Example 1, except that the composition of the coating liquid for black dye layer was changed to the composition listed in Table 1. The black dye layer of Comparative example 2 uses dyes used for the yellow layer, the magenta layer, and the cyan layer in Examples of Patent Literature 3 (JP-A No. 2003-20586) in combination.

The dyes represented by Formulas (C*1) and (C*2) in Table 1 are as follows.

[Chemical formula 10]

Formula (C*1)

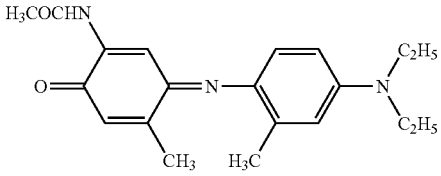

-continued

Formula (C*2)

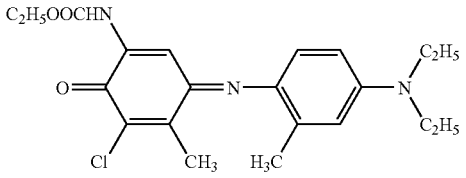

Comparative Example 3

A thermal transfer sheet of Comparative example 3 was produced similarly as in Example 1, except that the combination of the coating liquid for black dye layer was changed to the composition listed in Table 1. The black dye layer of Comparative example 3 uses the yellow dye used in Examples of Patent Literature 2 (JP-A No. 7-304272) for the combination instead of the dye represented by Formula (1).

The dye represented by Formula (Y*1) in Table 1 is as follows.

[Chemical formula 11]

Formula (Y*1)

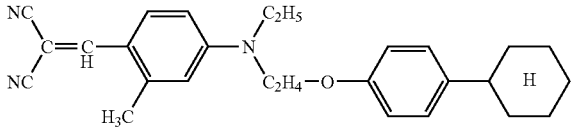

Comparative Examples 4 to 6

Thermal transfer sheets of Comparative examples 4 to 6 were produced similarly as in Example 1, except that each composition of the coating liquid for black dye layer was changed to the composition listed in Table 1. The black dye layer of Comparative example 4 uses dyes disclosed in Patent Literature 1 (JP-A No. 10-86535) in combination. The black dye layers of Comparative examples 5 and 6 uses dyes disclosed in Patent Literature 2 (JP-A No. 7-304272) in combination.

Dyes represented by Formulas (M*1), (M*2), and (M*3) in Table 1 are as follows. Disperse Red 343 in Table 1 is the name of color index.

[Chemical formula 12]

Formula (M*1)

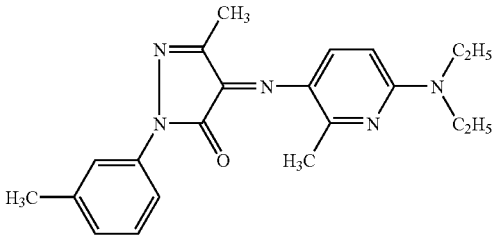

[Chemical formula 13]

Formula (M*2)

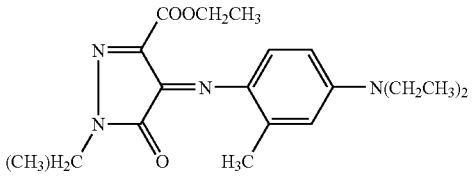

[Chemical formula 14]

Formula (M*3)

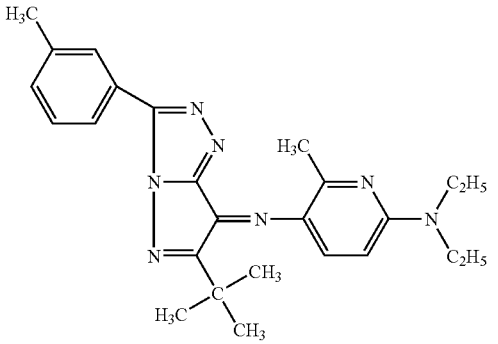

[Evaluation]

<Evaluation of Color Tone, Gradation Difference, and Density of Black Printed Matter>

Energies with different 15 levels were given to each of the thermal transfer sheets produced in Examples and Comparative examples in combination with the following thermal transfer image-receiving sheet under the environment of 25° C. and the relative humidity of 50%, and the following printing conditions. Thus, printed matter of the black dye layer having gradation of 15 levels was formed.

(Thermal Transfer Image-Receiving Sheet)

A thermal transfer image-receiving sheet specially designed for Compact photo printer CP-200 (product name) manufactured by Canon Inc. was used.

(Printing Conditions)

Thermal head; KGT-217-12 MPL20 (product name; manufactured by KYOCERA Corporation)

Average resistance of heating element; 2,994 (Ω)

Print density in main scanning direction; 300 dpi

Print density in sub scanning direction; 300 dpi

Applied voltage; 0.10 (w/dot)

One line period; 5.0 (msec.)

Temperature upon starting printing; 40 (° C.)

Applied pulse (gradation control method); A test printer of a multi-pulse system was provided which had such a pulse length that one line period was divided into 256 equal parts and wherein the number of divided pulses could be varied from 0 to 255 during one line period, a duty ratio of each divided pulse was fixed at 70%, and the number of pulses per line period was separated into 15 levels between 0 and 255; thereby, 15 levels of different energies can be provided.

[Evaluation of Color Tone (a* Value, b* Value), and Gradation Difference]

The chromaticity values L*, a*, and b* of 15 parts of different levels of gradations in each printed matter of the black dye layer having 15 levels of gradations were measured by means of a spectrometer (product name: Gretag Macbeth Spectrolino; manufactured by Gretag Macbeth) under the conditions including the white reference of the absolute value, and the density standard of D 50 light source and the observable field of view of 2°.

The color tone (a* value, b* value) for all parts printed by 15 levels of gradations was evaluated according to the following criteria.

(a* Value)

o: all a* values in 15 levels of gradations are in the range of −3 to 5.

x: there is a* value of less than −3 or more than 5.

(b* Value)

o: all b* values of 15 levels of gradations are in the range of −5 to 3.

x: there is b* value of less than −5 or more than 3.

The evaluation of gradation difference was performed by the following criteria using the difference between maximum and minimum values of 15 a* values and the difference between maximum and minimum values of 15 b* values, which were measured on 15 parts of different gradations.

(Amplitude of a* Value and b* Value)

o: the difference between maximum and minimum values is 5 or less.

x: the difference between maximum and minimum values is more than 5.

[Evaluation of Maximum Transfer Density]

The transfer density was evaluated by measuring a reflection density of the part printed by applying the highest energy among the parts of 15 levels of gradations by means of Macbeth reflection densitometer RD-918 (manufactured by SAKATA INX Corp.). The evaluation criteria are as follows.

(Maximum Transfer Density)

o: OD value is 1.95 or more.

x: OD value is less than 1.95.

<Evaluation of Resistance to Light>

By means of Xenon Weather Meter (product name: Xenon Weather Meter SX75; manufactured by SUGA TEST INSTRUMENTS CO., LTD.), the parts having the transfer density (OD value) of around 1 in the above printed matter was radiated with light for 48 hours at black panel temperature of 50±2° C. with the temperature in a chamber of 40° C., the relative humidity in the chamber of 60%, and the irradiance of 48 W/m$^2$ (at 300 to 400 nm). Then, the residual ratio of the printed matter was obtained by measuring the reflection density by means of Macbeth reflection densitometer RD-918 (manufactured by SAKATA INX Corp.). The residual ratio was obtained as follows:

Residual ratio (%)=(transfer density of printed matter after irradiation)/(transfer density of printed matter before irradiation)×100

Also the degree of discoloration of the printed matter was evaluated by ΔC and ΔE*ab. The evaluation criteria are as shown below. ΔC, and ΔE*ab were respectively obtained as follows by measuring the chromaticity values L*, a*, and b* by means of the above spectrometer under the conditions including the white reference of the absolute value, and the density standard of D 50 light source and the observable field of view of 2°.

ΔC=(difference of a* values of printed matter before and after irradiation)$^2$+(difference of b* values of printed matter before and after irradiation)$^2$ ΔE*ab=(difference of L* values of printed matter before and after irradiation)$^2$+(difference of a* values of printed matter before and after irradiation)$^2$+(difference of b* values of printed matter before and after irradiation)$^2$ (Residual Ratio)

o: Residual ratio is 90% or more.

x: Residual ratio is less than 90%.

(ΔC)

o: AC is 6 or less.

x: AC is more than 6.

(ΔEa* b*)

o: ΔE*ab is 10 or less.

x: ΔE*ab is more than 10.

<Evaluation of the Amount of Dye Transferred to Back Side>

The amount of dye transferred to the heat resistant slip layer was evaluated under the following conditions. The black dye layer and the heat resistant slip layer of the thermal transfer sheets obtained by each Example and Comparative example were faced each other, applied with a load of 20 kg/cm$^2$, and then kept for 96 hours at 40° C. with the relative humidity of 90%.

The amount of dye transferred to the heat resistant slip layer was evaluated under the criteria shown below. The color difference ΔE*ab of the heat resistant slip layer was similarly evaluated as the evaluation of resistance to light.

o: The color difference ΔE*ab of the heat resistant slip layer before and after being faced to the dye layer and kept under the load is less than 2.0 and is in good condition.

x: The color difference ΔE*ab of the heat resistant slip layer before and after being faced to the dye layer and kept under the load is 2.0 or more and is not in good condition.

The results of the above-mentioned evaluation of color tone, gradation difference, maximum transfer density, resistance to light and the amount of dye transferred to the back side are listed in Table 2.

TABLE 2

Results of Evaluation

| | Example 1 | Example 2 | Example 3 | Example 4 | Example 5 | Example 6 | Example 7 | Comparative Example 1 | Comparative Example 2 | Comparative Example 3 | Comparative Example 4 | Comparative Example 5 | Comparative Example 6 |
|---|---|---|---|---|---|---|---|---|---|---|---|---|---|
| a*value | ○ | ○ | ○ | ○ | ○ | ○ | ○ | ○ | X | X | X | X | X |
| b*value | ○ | ○ | ○ | ○ | ○ | ○ | ○ | X | X | X | ○ | X | X |
| Amplitude of a* value | ○ | ○ | ○ | ○ | ○ | ○ | ○ | X | X | X | X | ○ | X |
| Amplitude of b* value | ○ | ○ | ○ | ○ | ○ | ○ | ○ | ○ | X | ○ | ○ | X | ○ |
| Maximum Transfer Density | ○ | ○ | ○ | ○ | ○ | ○ | ○ | ○ | ○ | ○ | ○ | ○ | ○ |
| Resistance to Light (Residual ratio) | ○ | ○ | ○ | ○ | ○ | ○ | ○ | ○ | ○ | ○ | X | X | X |
| Resistance to Light (ΔC) | ○ | ○ | ○ | ○ | ○ | ○ | ○ | ○ | ○ | ○ | X | X | X |
| Resistance to Light (ΔE*ab) | ○ | ○ | ○ | ○ | ○ | ○ | ○ | ○ | ○ | ○ | X | X | X |
| Amount of Dye Transferred | ○ | ○ | ○ | ○ | ○ | ○ | ○ | ○ | ○ | ○ | X | X | X |

From the above results, in the thermal transfer sheets of Examples 1 to 8 using the combination of specific amounts of 5 to 7 kinds of dyes having specific structures, including the dye represented by Formula (1), the dye represented by Formula (2a) and/or the dye represented by Formula (2b), the dye represented by Formula (3), the dye represented by Formula (4a) and/or the dye represented by Formula (4b), and the dye represented by Formula (5) as the dyes in the black dye layer, it is clearly shown that the black dye layer, which can form a black image having jet-black color tone, small gradation difference of black and high resistance to light, and which has little offset of dyes to a back side layer during storage in a wound state, can be obtained.

The black dye layer of Comparative example 1 uses the dyes specified in the present invention in combination at the weight ratio different from the amounts specified in the present invention. The result clearly shows that black color tone took red tinge and the amplitude of a* value increased in Comparative example 1. Also, the black dye layer of Comparative example 3 uses the yellow dye used in Examples of Patent Literature 2 (JP-A No. 7-304272) for the combination instead of the dye represented by Formula (1). The result clearly shows that black color tone took yellow tinge and the amplitude of a* value increased. Further, from the results of Comparative example 2 and Comparative examples 4 to 6, it is clearly shown that the combination of dyes in prior art was not able to attain a desired black color tone and the gradation difference of black was large. Further, in Comparative examples 4 to 6, there were problems in both resistance to light and offset of dyes to the back side layer during storage in a wound state.

The invention claimed is:

1. A thermal transfer sheet comprising:

a substrate;

a heat resistant slip layer provided on one side of the substrate; and a black dye layer containing a dye and a binder provided on the other side of the substrate, wherein the black dye layer contains, with respect to 1 part by weight of a dye represented by the following Formula (1), 0.8 to 1.1 parts by weight of a dye represented by the following Formula (2a), dye represented by the following Formula (2b), or the sum of the dye represented by the following Formula (2a) and the dye represented by the following Formula (2b), 1.2 to 1.6 parts by weight of a dye represented by the following Formula (3), 1.3 to 1.7 parts by weight of a dye represented by the following Formula (4a), a dye represented by the following Formula (4b), or the sum of the dye represented by the following Formula (4a) and the dye represented by the following Formula (4b), and 1.8 to 2.3 parts by weight of a dye represented by the following Formula (5):

Formula (1)

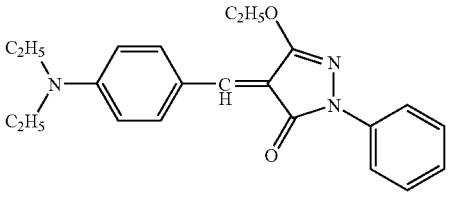

Formula (2a)

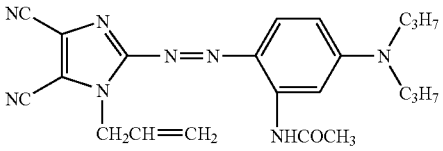

Formula (2b)

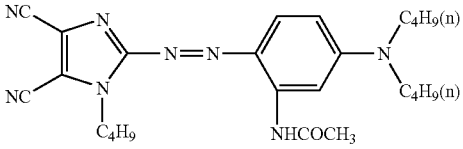

-continued

Formula (3)

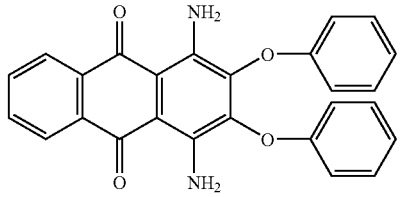

Formula (4a)

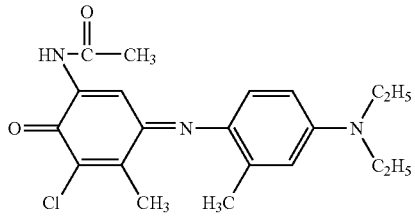

Formula (4b)

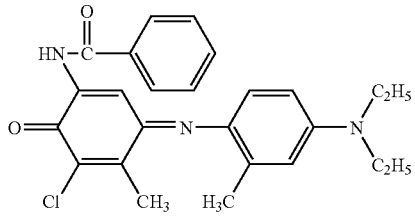

Formula (5)

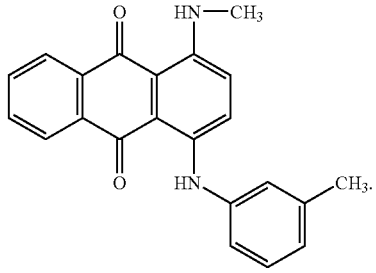

2. The thermal transfer sheet according to claim 1, wherein a* value and b* value in CIELAB color system of a printed matter obtained by using the black dye layer and an image-receiving paper are respectively −3 to 5 and −5 to 3.

3. The thermal transfer sheet according to claim 1 or 2, wherein a weight ration (D/B) of a total amount (D) of dyes and a total amount (B) of binders in the black dye layer is 2 to 2.5.

* * * * *